US012467710B1

(12) United States Patent
Lewin et al.

(10) Patent No.: US 12,467,710 B1
(45) Date of Patent: Nov. 11, 2025

(54) SELF-PROPELLED GUN SYSTEM

(71) Applicant: BAE SYSTEMS PLC, London (GB)

(72) Inventors: Richard Peter Lewin, Barrow-in-Furness (GB); Edward Elliott, Farnborough (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/868,314

(22) PCT Filed: May 11, 2023

(86) PCT No.: PCT/GB2023/051231
§ 371 (c)(1),
(2) Date: Nov. 22, 2024

(87) PCT Pub. No.: WO2023/227858
PCT Pub. Date: Nov. 30, 2023

(30) Foreign Application Priority Data

May 27, 2022 (EP) ..... 22275070
May 27, 2022 (GB) ..... 2207845

(51) Int. Cl.
*F41A 23/56* (2006.01)
*F41A 23/34* (2006.01)
*F41A 25/00* (2006.01)

(52) U.S. Cl.
CPC ..... *F41A 23/56* (2013.01); *F41A 23/34* (2013.01); *F41A 25/00* (2013.01)

(58) Field of Classification Search
CPC ..... F41A 25/00; F41A 25/08; F41A 25/06; F41A 25/10; F41A 25/12; F41A 25/22;
(Continued)

(56) References Cited

U.S. PATENT DOCUMENTS 4,708,051 A * 11/1987 Argon ..... F41F 1/06 D22/100
6,000,313 A * 12/1999 Becker ..... F41A 23/34 89/40.02

(Continued)

FOREIGN PATENT DOCUMENTS

GB 158 023 A 2/1921
WO WO2023227858 A1 11/2023

OTHER PUBLICATIONS

International Search Report and Written Opinion received for PCT/GB2023/051231. Mail Date: Jul. 19, 2023. 8 pages.

(Continued)

*Primary Examiner* — John Cooper
(74) *Attorney, Agent, or Firm* — Finch & Maloney PLLC

(57) ABSTRACT

A self-propelled gun system (10) comprising a chassis (200) to which is mounted a gun barrel (300) having a gun barrel axis (302). The system also has a chassis suspension system (400) comprising a first wheel arm (402) extending away from the chassis (200) to a first wheel (404), the first wheel (404) being rotatably mounted on the first wheel arm (402), the first wheel (404) configured for engagement with, and travelling along, a support surface (500) to support the chassis (200) a distance (Dz) apart from the support surface (500). There is also provided a recoil mitigation system (900) comprising a recoil support leg (902) which extends away from the chassis (200) to a foot end (904), the foot end (904) operable to engage with the support surface (500) during firing of a projectile (340) from the gun barrel (300). The foot end (904) of the recoil support leg (902) is operable to be spaced apart from the support surface (500) when the gun system (10) is in transit. The recoil support leg (902) is configured to react against recoil force (Fr) in the z-axis from the firing of a projectile (340) from the gun barrel (300). The recoil mitigation system (900) further comprising (Continued)

a wheel brake control device (600) configured for applying a braking force to the chassis first wheel (404) after the firing of a projectile (340) from the gun barrel (300) and after the rotatable first wheel (404) has started rotating along the support surface (500) in response to the firing of a projectile (340) from the gun barrel (300).

20 Claims, 5 Drawing Sheets

(58) Field of Classification Search
CPC ..... F41A 25/24; F41A 25/26; F41A 23/34; F41A 23/56
USPC ..... 89/37.08, 37.14, 40.05, 40.06, 40.11, 89/42.01, 42.02, 42.03, 43.01, 43.02, 89/44.01, 44.02, 37.09
See application file for complete search history.

(56) References Cited

U.S. PATENT DOCUMENTS 6,595,103 B1 * 7/2003 Kathe ..... F41A 3/78 89/7
2015/0174979 A1 * 6/2015 Raczek ..... F41A 23/34 89/43.01

OTHER PUBLICATIONS

Extended European Search Report Received for EP Application No. 22275070.5, dated Nov. 10, 2022. 4 pages.
GB Search Report under Section 17(5) received for GB Application No. 2207845.5, dated Nov. 25, 2022. 4 pages.

* cited by examiner

SELF-PROPELLED GUN SYSTEM

FIELD

The present invention relates to a self-propelled gun system.

In particular it relates to a self-propelled gun system with integral recoil mitigation system.

BACKGROUND

When artillery systems fire, the gun generates very large recoil forces which must be managed and dissipated. Failing to dissipate the forces leads to the system moving in uncontrolled ways, making them hard to manage and/or dangerous. When firing at low angles the recoil loads may generate an overturning moment which may cause the weapon to jump or even overturn during the shot. Lightweight systems tend to be fixed to the ground e.g. via braked wheels/tracks or spades.

In such systems the recoil forces are managed by recoil systems and the forces can be reduced by increasing the length of the recoil stroke and/or increasing the recoiling mass as, via conservation of momentum, this reduces the recoil velocity and hence energy. However, these features all add weight, making it very hard to create a stable light weight system.

Conventionally, self-propelled gun systems (i.e. those which have a powertrain, but which are lighter than heavy weaponry such as tanks) have wheels, drive and braking systems needed for transit in addition to support systems which deal with the very large impulse directional loads experienced during operation of the gun. This adds to extra weight and complexity, making it harder to achieve a desired weight limit.

Hence a self-propelled gun system which is relatively lightweight and yet stable when absorbing recoil forces is highly desirable.

SUMMARY

According to the present disclosure there is provided an apparatus and system as set forth in the appended claims. Other features of the invention will be apparent from the dependent claims, and the description which follows.

Accordingly there may be provided a self-propelled gun system (10) comprising a chassis (200) extending along an x-axis, a first end (202) of the chassis (200) and a second end (204) of the chassis (200) spaced apart from one another along the x-axis. The chassis (200) may extend along a y-axis, a first side (206) of the chassis (200) and a second side (208) of the chassis (200) spaced apart from one another along the y-axis. The x-axis is at right angles to the y-axis.

The self-propelled gun system (10) may further comprise a gun barrel (300) having a gun barrel axis (302), the gun barrel (300) being mounted to the chassis (200) by a pivot mount (304), the gun barrel (300) being pivotable relative to the x-axis about a pivot axis (310) aligned and/or parallel with the y-axis.

The self-propelled gun system (10) may further comprise a chassis (200) suspension system (400) comprising a first wheel arm (402) extending away from the chassis (200) to a first wheel (404), the first wheel (404) being rotatably mounted on the first wheel arm (402), the first wheel (404) configured for engagement with, and travelling along, a support surface (500) to support the chassis (200), when in transit, a distance (Dz) apart from the support surface (500) in a z-axis, the z-axis being perpendicular to the x-axis and y-axis.

The self-propelled gun system (10) may further comprise a recoil mitigation system (900) comprising a recoil support leg (902) which extends away from the chassis (200) to a foot end (904), the foot end (904) operable to engage with the support surface (500) during firing of a projectile (340) from the gun barrel (300). The foot end (904) of the recoil support leg (902) may be operable to be spaced apart from the support surface (500) when the gun system (10) is in transit.

The recoil support leg (902) may be configured to react against recoil force (Fr) in the z-axis from the firing of a projectile (340) from the gun barrel (300).

The recoil mitigation system (900) may further comprise a wheel brake control device (600) configured for applying a braking force to the chassis first wheel (404) after the firing of a projectile (340) from the gun barrel (300) and after the rotatable first wheel (404) has started rotating along the support surface (500) in response to the firing of a projectile (340) from the gun barrel (300).

The gun barrel (300) may be constrained to pivot about the pivot axis (310) in a plane of movement extending through the x-axis and z-axis. The gun barrel (300) may be constrained to pivot about the pivot axis (310) between −5 degrees to the x-axis and +75 degrees to the x-axis.

The gun barrel (300) may be rotatable about the z-axis, limited to be rotatable no more than +/−5 degrees relative to a direction parallel to the x-axis around the z-axis.

The recoil support leg (902) may be pivotable and/or extendable between: a first configuration in which the foot end (904) of the recoil support leg (902) is spaced apart from the support surface (500) when the gun system (10) is in transit; and a second configuration in which the foot end (904) is engaged with the support surface (500) during firing of a projectile (340) from the gun barrel (300).

The foot end (904) of the recoil support leg (902) may comprise a sledge (920) configured to frictionally engage with the support surface (500) to inhibit movement of the chassis (200) in the x-axis by a recoil force (Fr) from the firing of a projectile (340) from the gun barrel (300).

The foot end (904) of the recoil support leg (902) may be defined by a wheel (922) rotatably mounted to recoil support leg (902).

The self-propelled gun system (10) may further comprise a wheel brake control device (600) configured for applying a braking force to the recoil support leg rotatable wheel (922) after the firing of a projectile (340) from the gun barrel (300) and after the rotatable first wheel (404) has started rotating along the support surface (500) in response to the firing of a projectile (340) from the gun barrel (300).

The wheel brake control device (600) of the first wheel arm rotatable wheel (404) and/or recoil support leg (902) rotatable wheel (922) may be a regenerative braking device (602), magnetic impedance braking device and/or friction braking device.

The regenerative braking device (602) may be operably linked with a rechargeable electric storage device (700) and the chassis first wheel (404) and/or the rotatable wheel (922) of the recoil support leg (902) for generating an electrical current by decelerating the chassis first wheel (404) and/or recoil support leg rotatable wheel (922) and thereby dissipating the recoil of the gun barrel (300).

The self-propelled gun system (10) may further comprise a processor (610) in communication with the regenerative braking device (602) and the rechargeable electric storage device (700) such that in response to a first movement of the chassis (200) along the support surface (500), the processor (610) causes the regenerative device (602) to decelerate the chassis first wheel (404) and/or recoil support leg (902) rotatable wheel (922).

The chassis first wheel arm (402) may extend away from the chassis (200) to the first wheel (404) at an angle to the x-axis, y-axis and/or z-axis. A resilient suspension unit (420) may extend between the chassis (200) and the chassis first wheel arm (402).

The gun barrel (300) may have a front end (320) and a muzzle (322) provided towards the front end (320). The gun barrel (300) may have a rear end (324) and a breech assembly (326) provided at the rear end (324).

The gun barrel (300) may be coupled to a recoil mechanism (330) comprising a recuperator (332) for mitigating a recoil force (Fr) along the gun barrel axis (302) from the firing of a projectile (340) from the gun barrel (300).

The chassis suspension system (400) may further comprise a first leg strut (240), the first leg strut (240) pivotably attached to the chassis (200) at a coupling end (242), and extending to a foot (244) configured for engagement with the support surface (500) to support the chassis (200) apart from the support surface (500).

The unladen mass of the self-propelled gun system may be no greater than 10 tonnes or no greater than 5 tonnes.

Hence there is provided a self-propelled gun system with a recoil mitigation system configured to react against recoil force in a vertical (z-axis) direction and horizontal (x-axis) direction which is stable and lightweight compared to examples of the related art.

BRIEF DESCRIPTION OF THE FIGURES

Embodiments of the invention will now be described by way of example only with reference to the figures, in which.

DETAILED DESCRIPTION

Figure 1:
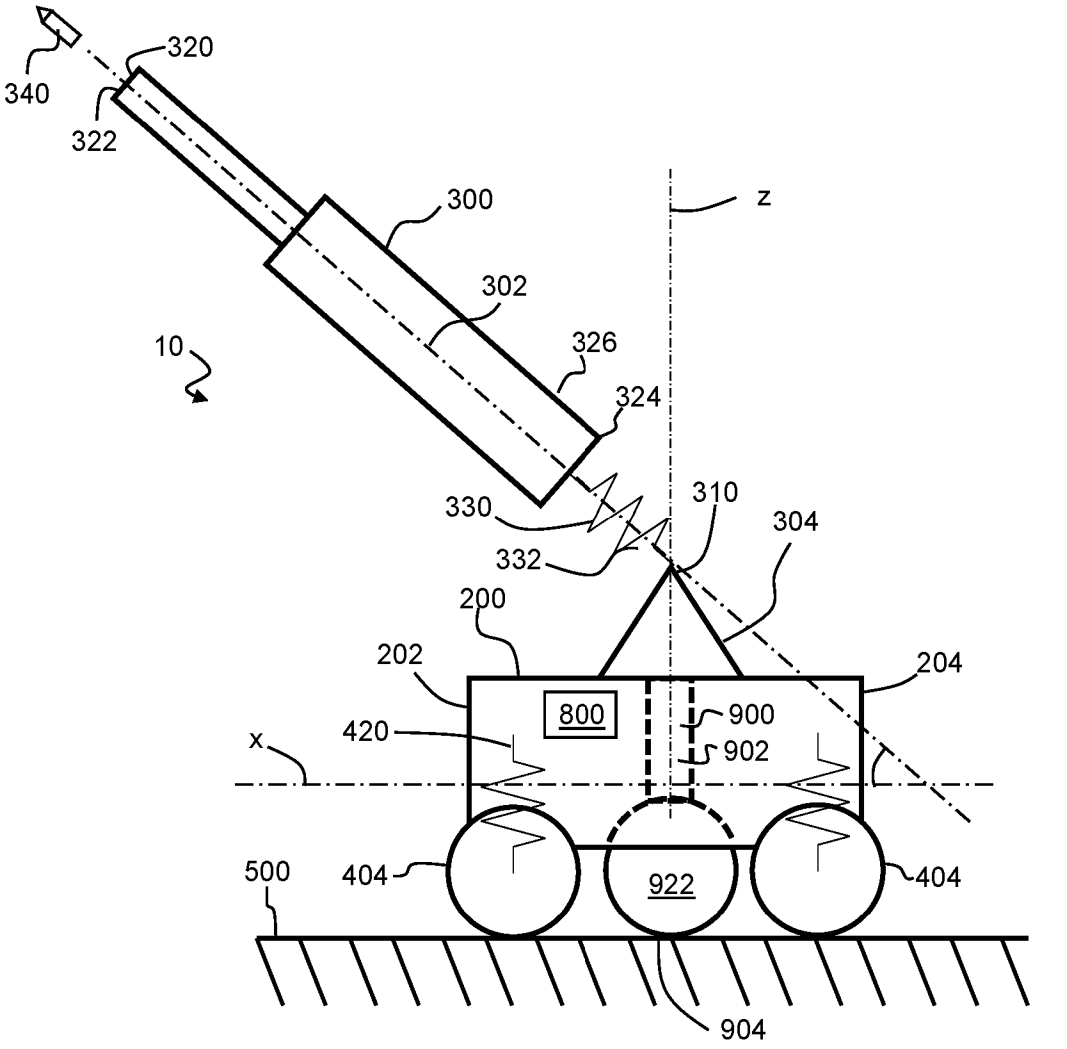
FIG. 1 shows a diagrammatic side view of a first example of a self-propelled gun system according to the present disclosure, at one of many gun firing angles.

The present disclosure relates to a self-propelled gun system 10 having a recoil mitigation system 100. This is shown diagrammatically FIGS. 1 to 7.

The self-propelled gun system 10 may comprise a powertrain 800 such as an internal combustion engine, electric motor or hybrid motor, wherein the drive may be transferred by an appropriate means (for example, drive shafts) to wheels 404, 1404. Other apparatus on the system 10 may be electrically powered. The wheels 404, 1404 are coupled to and driveable by the powertrain 800 to propel the gun system 10.

The unladen mass of the self-propelled gun system 10 may be no greater than 10 tonnes. The unladen mass of the self-propelled gun system 10 may be no greater than 5 tonnes. Hence there is provided a self-propelled gun system 10 which is considerably lighter than a tank, and hence easier to transport and requiring less raw materials to construct.

As illustrated in the figures, the self-propelled gun system 10 comprises a chassis 200 extending along an x-axis. A first end 202 of the chassis 200 and a second end 204 of the chassis 200 are spaced apart from one another along the length of the chassis 200 along the x-axis. The chassis 200 extends along a y-axis along the width of the chassis 200. A first side 206 of the chassis 200 and a second side 208 of the chassis 200 are spaced apart from one another across the width of the chassis 200 along the y-axis. The x-axis is at right angles to the y-axis.

As shown in FIGS. 1 to 6, the gun barrel 300 has a barrel axis 302, the barrel 300 being mounted to the chassis 200 by a pivot mount 304. The barrel 300 is pivotable relative to the x-axis about a pivot axis 310 aligned and/or parallel with the y-axis.

The barrel 300 may have a front end 320, with a muzzle 322 provided towards the front end 320. The barrel 300 has a rear end 324, with a breech assembly 326 provided at the rear end 324.

As shown in FIG. 1, the gun barrel 300 may be coupled to a recoil mechanism 330 comprising a recuperator 332 for mitigating a recoil force Fr along the barrel axis 302 from the firing of a projectile 340 from the gun barrel 300. As shown in the end views of FIGS. 2, 3, 5, 6, the self-propelled gun system 10 further includes a chassis suspension system 400 comprising a first wheel arm 402 extending away from the chassis 200 to a first wheel 404. The chassis first wheel arm 402 may extend away from the chassis 200 towards a support surface 500 (e.g. the ground) at an angle to the x-axis, y-axis and/or z-axis. The first wheel 404 is rotatably mounted on the first wheel arm 402.

The self-propelled gun system 10 may further comprise a second wheel arm 1402 configured, mounted and operable as the first wheel arm 402. As with the first wheel arm 402, the second wheel arm 1402 extends away from the chassis 200, towards the support surface 500 (e.g. the ground) at an angle to the x-axis, y-axis and/or z-axis, to a second wheel 1404. The second wheel 1404 is rotatably mounted on the second wheel arm 1402.

The second wheel arm 1402 is configured to operate in the same way as the first wheel arm 402. Hence features and operation of the first wheel arm 402 herein described are equally applicable to the second wheel arm 1402, even where the second arm 1402 is not specifically referenced.

Hence the platform/chassis 200 may be (at least in part) supported on wheels 404, 1404 via a suspension system 400.

Figure 5:
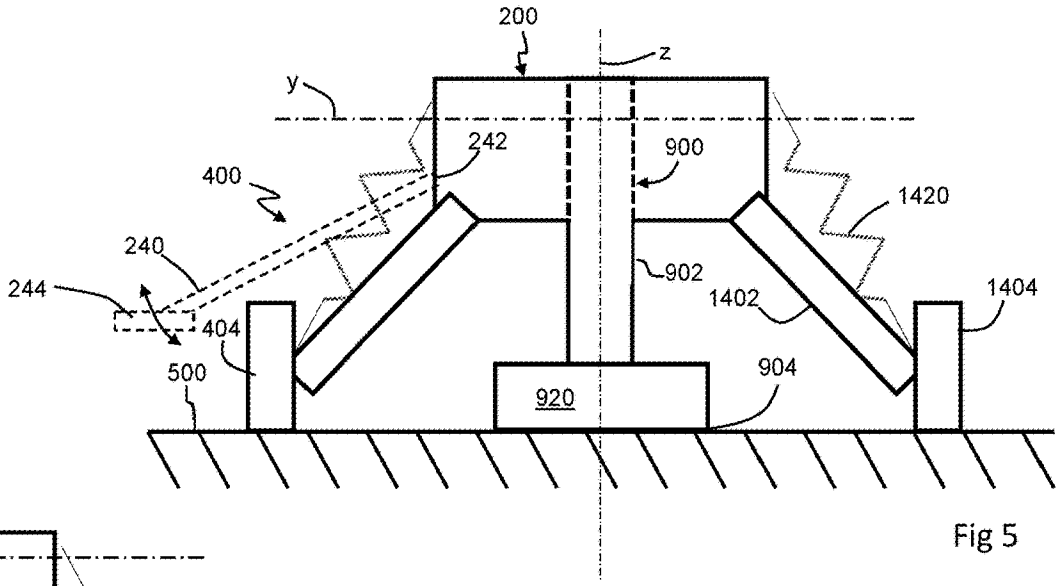
FIG. 5 illustrates an end on view of the recoil mitigation system of the second example, shown in a firing configuration.
Figure 6:
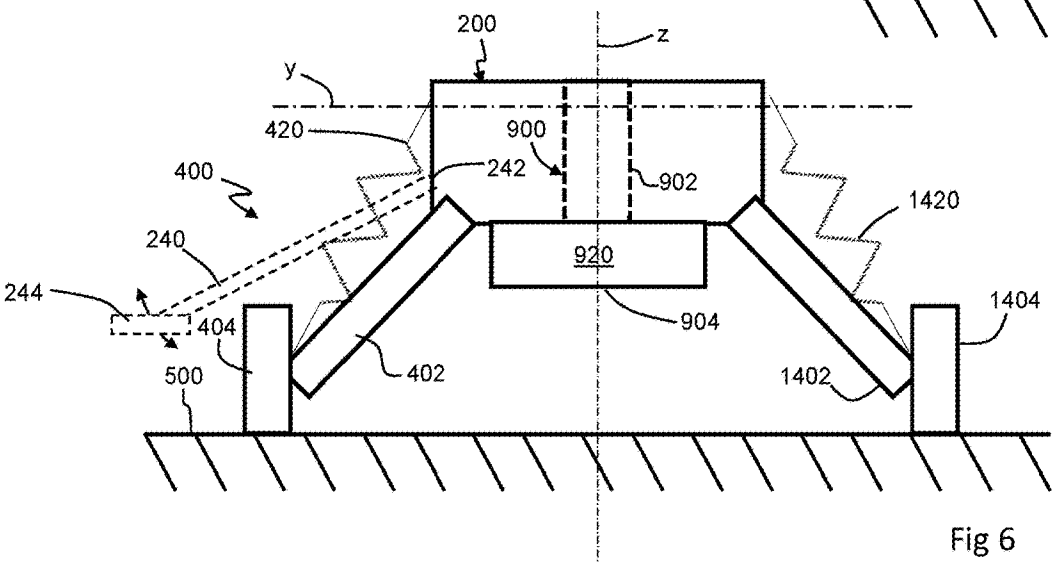
FIG. 6 illustrates an end on view of the recoil mitigation system of the second example, shown in a transit configuration.
Figure 7:
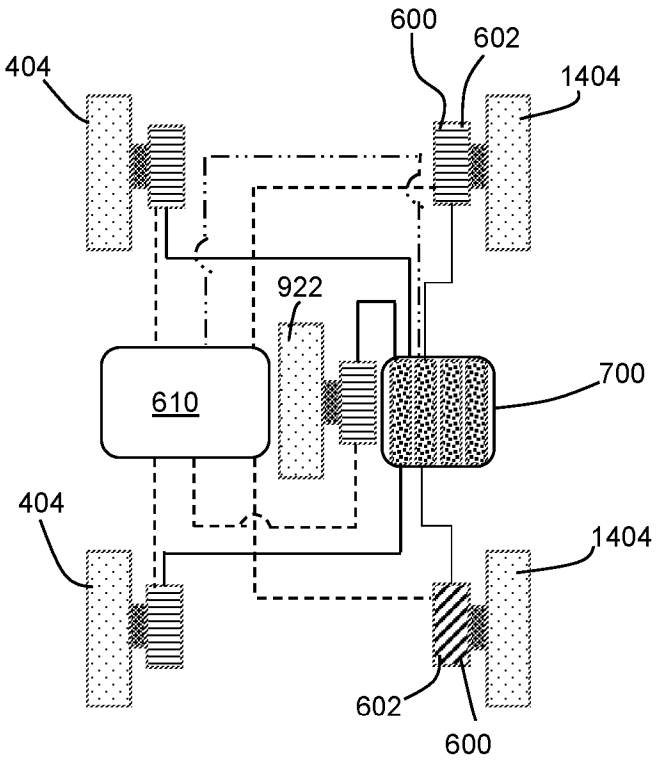
FIG. 7 illustrates a plan view of an example of a self-propelled gun system according to the present disclosure with a regenerative braking system which forms part of the recoil mitigation system of the present disclosure.

As shown in FIGS. 5 to 7, the first wheel 404 is configured for engagement with the support surface 500 (e.g. the ground). Hence the first wheel arm 402 and first wheel 404 are configured to support the chassis 200, when in transit, a distance Dz apart from the support surface 500 in the z-axis, the z-axis being perpendicular to the x-axis and y-axis. Likewise, the second wheel 1404 is configured for engagement with the support surface 500, the second wheel arm 1402 and second wheel 1404 configured to support the chassis 200, when in transit, the distance Dz apart from the support surface 500 in the z-axis.

Hence the second wheel arm 1402 and second wheel 1404 are configured to support the chassis 200 together with the first wheel arm 402 and first wheel 404 the distance (Dz) apart from the support surface 500 in a z-axis.

The first wheel arm 402 and second wheel arm 1402 extend away from each other on opposite sides of the chassis 200. That is to say the first wheel arm 402 and second wheel arm 1402 are opposite each other across the x-axis. Put another way, the first wheel arm 402 extends away from the chassis 200 from the first side 206 of the chassis 200 and the second wheel arm 1402 extends away from the chassis 200 from the second side 208 of the chassis 200.

Figure 4:
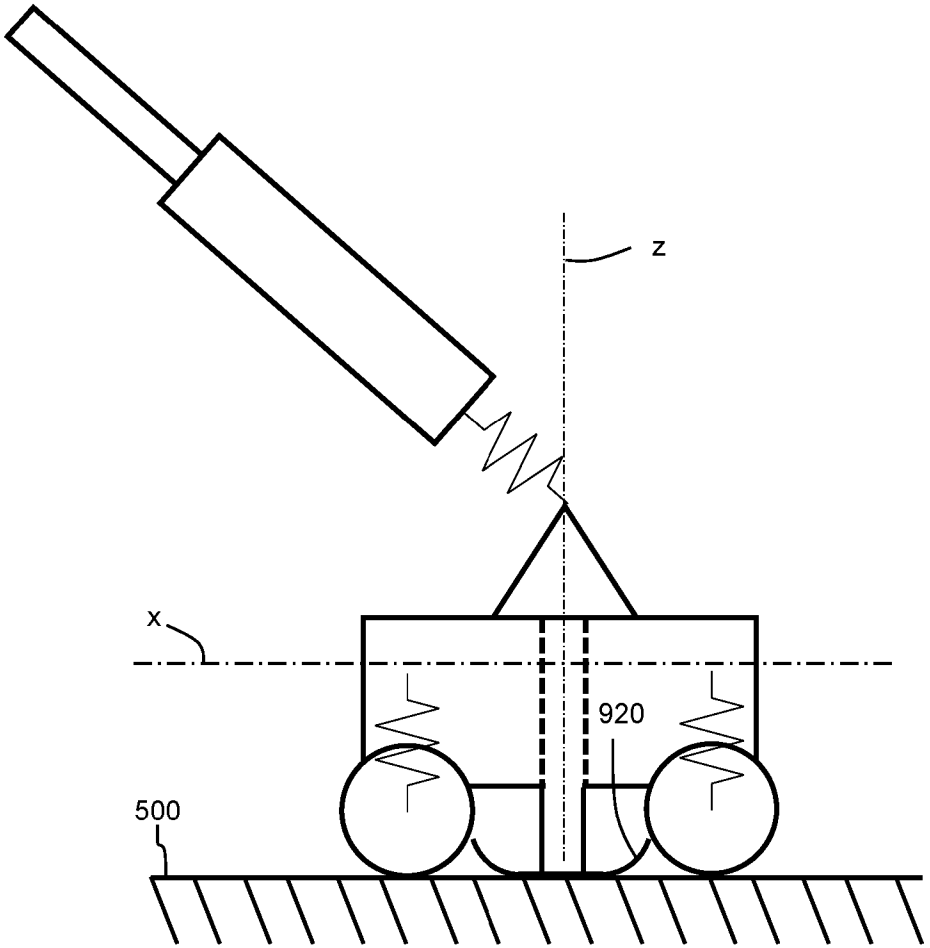
FIG. 4 shows a diagrammatic side view of a second example of a self-propelled gun system according to the present disclosure, at one of many gun firing angles.

Hence the wheel arm 402 and the second wheel arm 1402 form a pair of wheel arms 402, 1402 to which are attached a pair of wheels 404, 1404. As shown in FIGS. 1, 4, 7 the gun system 10 may comprise further pairs of wheel arms 402, 1402 and wheels 404, 1404. Hence there may be provided two pairs of wheel arms 402, 1402 and wheels 404, 1404. In other examples, not shown, there may be provided three, four or more pairs of wheel arms 402, 1402 and wheels 404, 1404 along the length of the chassis. Each pair of wheel arms 402, 1402 and wheels 404, 1404 may be spaced apart from the others along the length (i.e. x-axis) of the chassis 200.

Hence, in such examples, the or each pair of wheel arms 402, 1402 work together to support the chassis 200 the distance Dz apart from the support surface 500 in a z-axis.

In some examples, a single wheel arm 402 and wheel 404 may be provided in isolation (i.e. without a corresponding second wheel arm 1402 and second wheel 1404, for example where the self-propelled vehicle has only three wheels, two of which form a pair opposite one another across the x-axis, and the third being spaced apart from the others along the x-axis.

As shown in FIGS. 2, 3, 5, 6, the chassis suspension system 400 may further comprise a first leg strut 240, the first leg strut 240 pivotably attached to a side 206, 208 of the chassis 200 at a coupling end 242, and extending to a foot 244 configured for engagement with the support surface 500 to support the chassis 200 apart from the support surface 500. A second leg strut 240 may be provided which is attached to, and extends away from, the second side 208 of the chassis 200. Such pairs of leg struts may be provided along the length of the chassis 200. The leg strut(s) are configured to provide additional stability in addition to the wheel arms 402, 1402 and wheels 404, 1404.

A resilient suspension unit 420 is provided to bias the first wheel arm 402. Likewise, in examples in which the second wheel arm 1402 is present, a resilient suspension unit 1420 may be provided to bias the second wheel arm 1402. The resilient suspension unit 420 may extend between the chassis 200 and the chassis first wheel arm 402. The resilient suspension unit 1420 may extend between the chassis 200 and the chassis second wheel arm 1402. The resilient suspension units 420, 1420 are provided to bias the first wheel arm 402 and second wheel arm 1420 to move the chassis 200 back to being spaced part from the support surface 500 by preferred distance Dz for transit after displacement of the chassis 200 away from the preferred distance Dz. For example, the displacement may be in response to the chassis moving over rough ground, with the resilient suspension unit 420, 1420 acting to absorb shock/bounce loads as well as maintaining a desired ride height following a shock/bounce load.

That is to say, the chassis suspension system 400 is configured to position the chassis 200 at a preferred height above the support substrate 500 for transit, for example when the self-propelled vehicle is travelling from one location to another over land.

The resilient suspension units 420, 1420 may comprise at least one of air springs, switchable shock absorbers, hydropneumatic, hydrolastic, and hydragas suspensions. The resilient suspension units 420, 1420 may be configured to vary their spring stiffness. The resilient suspension units 420, 1420 may be configured to vary their damping stiffness.

The gun barrel 300 may be constrained to pivot about the pivot axis 310 aligned and/or parallel with the y-axis in a plane of movement extending through the x-axis and z-axis. For example, the gun barrel 300 may be pivotably mounted using a trunnion mount, cylindrical bearing or bushing.

The gun barrel 300 is constrained to pivot about the pivot axis 310 between 5 degrees below the x-axis and 75 degrees above the x-axis. That is to say, the gun barrel 300 is constrained to pivot about the pivot axis 310 between −5 degrees relative to the x-axis (i.e. pointing downwards) and +75 degrees relative to the x-axis (i.e. pointing upwards).

Alternatively or additionally, the gun barrel 300 is rotatable about the z-axis, limited (i.e. constrained) to be rotatable no more than +/−5 degrees from alignment with x-axis around the z-axis. For example, where present, the trunnion mount may be rotatably mounted to rotate about the z-axis.

As shown in FIGS. 2, 3, 5, 6 the gun system 10 may further comprise a recoil mitigation system 900 comprising a recoil support leg 902 which extends away from the chassis 200 to a foot end 904. The recoil support leg 902 may extend away from the underside of the chassis 200.

Figure 2:
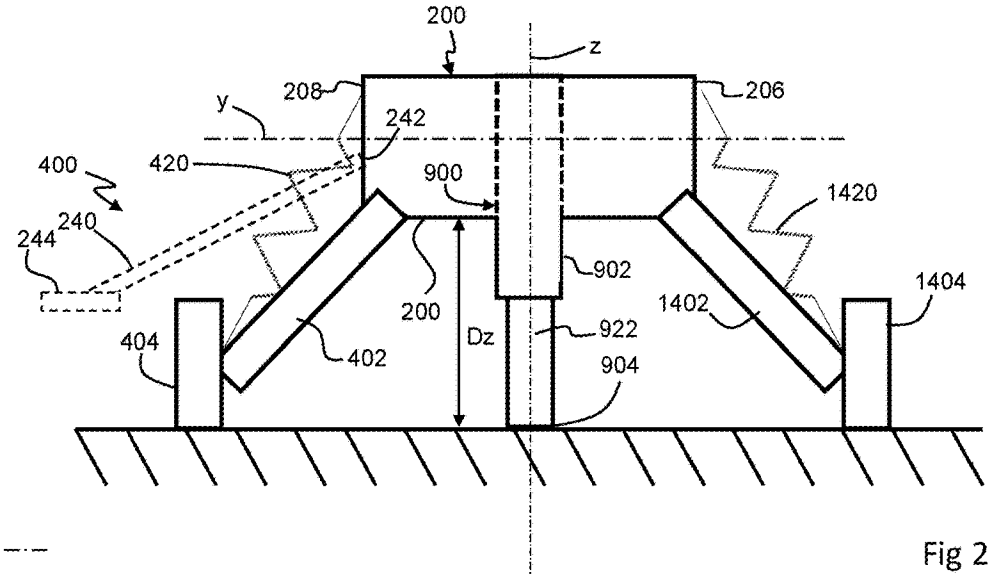
FIG. 2 illustrates an end on view of the recoil mitigation system of the first example, shown in a firing configuration.

As shown in FIGS. 2, 5, the foot end 904 is operable to engage with the support surface 500 during firing of a projectile 340 from the gun barrel 300. The recoil support leg 902 is configured to react against recoil force (Fr) in the z-axis from the firing of a projectile 340 from the gun barrel 300.

Figure 3:
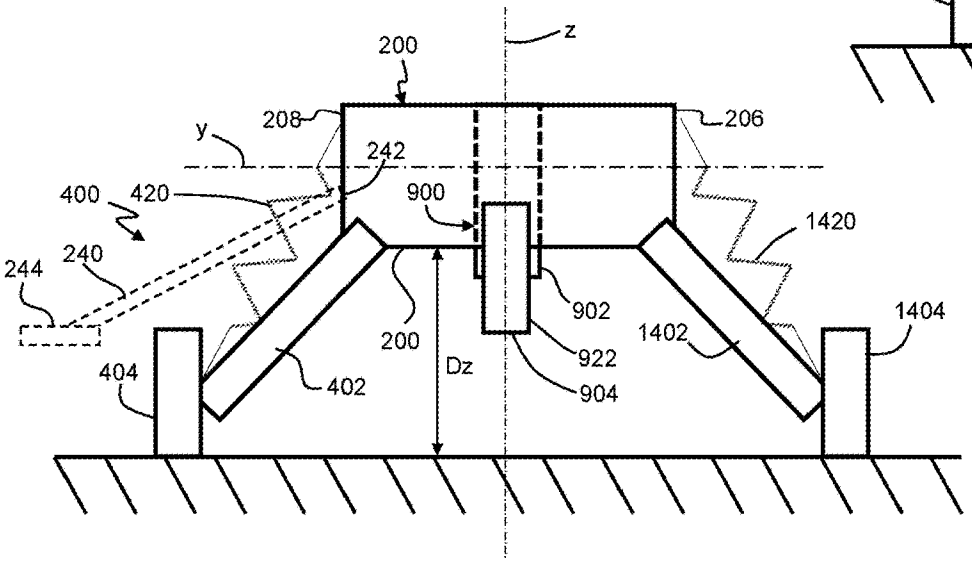
FIG. 3 illustrates an end on view of the recoil mitigation system of the first example, shown in a transit configuration.

As shown in FIGS. 3, 6 the foot end 904 of the recoil support leg 902 is operable to be spaced apart from the support surface 500 when the gun system 10 is in transit.

As shown in FIG. 7, the recoil mitigation system 900 further comprises a wheel brake control device 600 configured for applying a braking force to the chassis first wheel 404 (or wheels 404, 1404) after the firing of a projectile 340 from the gun barrel 300 and after the rotatable first wheel 404 (or wheels 404, 1404) has/have started rotating along the support surface 500 in response to the firing of a projectile 340 from the gun barrel 300. That is to say the wheel brake control device 600 is configured for applying a braking force to the chassis first wheel 404 (or wheels 404, 1404) in response to movement of the chassis 200 in the x-axis by a recoil force (Fr) from the firing of a projectile 340 from the gun barrel 300. When the projectile is fired, the wheels 404, 1404 are free to rotate/move. Only after the firing of the projectile is braking force applied.

The recoil support leg 902 may be pivotable and/or extendable between (as shown if FIGS. 3, 6) a first configuration (e.g. a transit configuration or retracted configuration) in which the foot end 904 of the recoil support leg 902 is spaced apart from the support surface 500 when the gun system 10 is in transit, and (as shown in FIGS. 2, 5) a second configuration (e.g. a firing configuration or deployed configuration) in which the foot end 904 is engaged with the support surface 500 during firing of a projectile 340 from the gun barrel 300. In examples in which the recoil support leg 902 is pivotable, it may extend from a pivot point on the chassis (for example, on the underside, in a compartment within the chassis, or on a side of the chassis). In examples in which the recoil support leg 902 is extendable, it may extend from a mount on the chassis (for example, on the underside, in a compartment within the chassis, or on a side of the chassis) which it slides and/or telescopically extends therefrom.

In one example, as shown in FIGS. 4, 5, 6, the foot end 904 of the recoil support leg 902 may comprise a sledge 920 configured to frictionally engage with the support surface 500 to inhibit movement of the chassis 200 in the x-axis by a recoil force (Fr) from the firing of a projectile 340 from the gun barrel 300. Hence the sledge 920 may comprise skids and/or an engagement surface for resting on the support surface 500 to thereby resist motion along the support surface 500 (e.g. to arrest horizontal motion, for example in the x-axis).

In another example, as shown in FIGS. 1, 2, 3 the foot end 904 of the recoil support leg 902 may be defined by a wheel 922 rotatably mounted to recoil support leg 902.

In examples in which the rotatable wheel 922 is provided on the recoil support leg 902, the wheel brake control device 600 may be configured for applying a braking force to the recoil support leg rotatable wheel 922 after the firing of a projectile 340 from the gun barrel 300 and after the chassis wheels 404, 1404 has started rotating (e.g. moving/spinning) along the support surface 500 in response to the firing of a projectile 340 from the gun barrel 300. That is to say, there may be provided a wheel brake control device 600 configured for applying a braking force to the recoil support leg rotatable wheel 922 after the firing of a projectile 340 from the gun barrel 300 and after the chassis wheels 404, 1404 and recoil support leg rotatable wheel 922 have started rotating along the support surface 500 in response to movement of the chassis 200 in the x-axis by a recoil force (Fr) from the firing of a projectile 340 from the gun barrel 300.

That is to say, when a projectile is fired, the wheel arm wheels 404, 1404 and recoil support leg rotatable wheel 922 are free to rotate/move. Only after the firing of the projectile is braking force applied. Put another way, the entire vehicle is allowed to roll backwards under free recoil. Once the vehicle is moving its movement is then arrested by applying brakes on the wheels.

The brake control device 600 may be configured to gradually and/or intermittently apply the braking force to the respective chassis wheels 404, 1404 and recoil support leg rotatable wheel 922, after the wheel 404, 1404 and recoil support leg rotatable wheel 922 has/have started rotating. This arrangement is operable to prevent wheel skid.

The wheel brake control device 600 of the wheel arm rotatable wheels 404, 1404 and/or recoil support leg 902 rotatable wheel 922 may be a regenerative braking device 602, magnetic impedance braking device and/or a friction braking device.

As shown in FIG. 7, the regenerative braking device 602 may be operably linked with a rechargeable electric storage device (e.g. battery) 700 and the chassis wheel 404 (or wheels 404, 1404) and/or (in examples where present) the rotatable wheel 922 of the recoil support leg 902 for generating an electrical current by decelerating the chassis wheels 404, 1404 and/or recoil support leg rotatable wheel 922 and thereby dissipating the recoil of the gun barrel 300.

That is to say, the processor 610 may be operable to cause the regenerative braking device 602 to act on (e.g. decelerate) one or more of the chassis wheels 404, 1404 and/or recoil support leg rotatable wheel 922 on the gun system.

Electrical power generated by the regenerative braking device 602 may be stored by the battery 700.

As also shown in FIG. 7, the self-propelled gun system 10 may further comprise a processor 610 in communication with the regenerative braking device 602 and to the rechargeable electric storage device 700 such that in response to a first movement of the chassis 200 along the support surface 500 in the x axis, the processor 610 causes the regenerative device 602 to act on (e.g. decelerate) the chassis first wheel 404 and/or recoil support leg 902 rotatable wheel 922.

Hence the or each pair of wheel arms 402, 1402 work together to support the chassis 200 the distance Dz apart from the support surface 500 in a z-axis primarily when the gun system 10 is in transit, with a recoil in the z axis mitigated by the recoil support leg 902 and sledge 920 or the recoil support leg 902 and rotatable wheel 922.

In the example of FIGS. 1 to 3, in a firing configuration when the gun barrel 300 is horizontal, the horizontal component of recoil forces are absorbed by braking the chassis wheels 404, 1404, and the recoil support leg 902 rotatable wheel 922 i.e. allowing the platform to start to travel during recoil (hence with no brake applied to any of the wheels, and hence with no braking force applied), and then engaging brake 600, of whatever kind, when recoil finished (i.e. after firing of the projectile). However the suspension 400 (i.e. wheel arms 402, 1402 and resilient suspension units 420, 1420 play almost no part in mitigating recoil in this configuration, other than being a connection to the chassis wheels 404, 1404.

In the example of FIGS. 4 to 6, in a firing configuration when the gun barrel 300 is horizontal, the horizontal component of recoil forces are absorbed by braking the chassis wheels 404, 1404 and by virtue of frictional contact between the recoil support leg sledge 920 and the support surface 500 i.e. allowing the platform to start to travel during recoil (hence with no brake applied, and hence with no braking force applied apart from frictional contact between the recoil support leg sledge 920 and the support surface 500), and then engaging brake 600 on the chassis wheels 404, 1404, when recoil finished (i.e. after firing of the projectile). However the suspension 400 (i.e. wheel arms 402, 1402 and resilient suspension units 420, 1420 play almost no part in mitigating recoil in this configuration, other than being a connection to the chassis wheels 404, 1404

Vertical component of recoil forces are absorbed by the recoil support leg 902 and sledge 920 or the recoil support leg 902 and rotatable wheel 922.

Hence at high angle firing gun conditions, there is a load path from the chassis 200 to the support surface 500 via the recoil support leg 902 and sledge 920 or the recoil support leg 902 and rotatable wheel 922. The chassis suspension system 400 plays no part in absorbing vertical component of recoil forces. Also, if there is no horizontal component (e.g. in the x-axis) then the wheel brake control device 600, chassis wheels 404, 1404 and recoil support leg 902 (with sledge 920 or rotatable wheel 922) play no part in absorbing recoil forces.

In positions intermediate between the barrel 300 being horizontal the barrel being vertical, both the chassis wheels 404, 1404, and where present the recoil support leg 902 rotatable wheel 922 and recoil support leg 902 play a part in recoil mitigation.

Hence the recoil support leg 902 and sledge 920 or the recoil support leg 902 and rotatable wheel 922 prevents the chassis 200 from contacting the support surface 500 during firing of the gun. This is advantageous as it provides a stable basis for the chassis (e.g. supported by the chassis wheels 404, 1404 and the chassis is prevented from being forced into the ground by the recoil support leg 902 and sledge 920 or the recoil support leg 902 and rotatable wheel 922).

An additional benefit is that a self-propelled gun system 10 according to the present disclosure may be quickly switched between the first configuration (e.g. the transit configuration, as shown in FIGS. 3,6) and the second configuration (e.g. the firing configuration, as shown in FIGS. 1, 2, 4, 5). This enables the gun system 10 to be quickly set up upon arrival at a desired destination (e.g. switched from a transit configuration to a firing configuration) and also quickly prepared for transit (e.g. switched from a firing configuration to a transit configuration) once firing is complete.

The amount of regenerative braking (i.e. braking force applied to the wheels) may be varied according to a predetermined relationship.

The predetermined relationship may be a function of: a mass of a projectile 340 being fired from the gun barrel 300, the type and mass of charge provided to propel the projectile 340 and/or angle of the barrel axis 302 relative to the x-axis.

The predetermined relationship may be a function of: expected recoil force and/or angle of the barrel axis 302 relative to the x-axis.

The free recoil can only be achieved if there is little to no traverse at the cannon/elevating mass so that recoil is always straight back through the wheels/tracks, thereby allowing them to roll. This requires all/most of the gun traversing to be done at a whole platform level by using steering/the wheels and/or suspension adjustments.

In a further example, wheel arms 402, 1402 may be configured to pivot relative to the chassis 200 such that the chassis 200 may be lowered to make contact with the supporting surface 500. Hence, in such an example, there may be provided a self-propelled gun system 10 comprising a recoil mitigation system 900 in which, in the firing configuration, the base of the chassis 200 is operable to engage with the support surface 500 (i.e. during firing of a projectile 340 from the gun barrel 300). That is, the base (underside) of the chassis is configured to react against recoil force (Fr) in the z-axis from the firing of a projectile 340 from the gun barrel 300. The chassis wheels 404, 1404 are in contact with the support surface 500 such that, should the chassis move along the support surface in the horizontal (x-axis) direction, the chassis wheels 404, 1404 will rotate and the base of the chassis will be in frictional engagement with the support surface 500, acting in the same way as the sledge 920 to arrest movement of the chassis 200 along the support surface 500. Hence, akin to the previous examples, the wheel brake control device 600 is configured for applying a braking force to the chassis first wheel 404 (or wheels 404, 1404) after the firing of a projectile 340 from the gun barrel 300 and after the rotatable first wheel 404 (or wheels 404, 1404) has started rotating along the support surface 500 in response to the firing of a projectile 340 from the gun barrel 300.

The suspension system 400 is operable to lift the chassis a distance (Dz) apart from (i.e. free of) the support surface 500 in the z-axis such that the self-propelled gun system 10 is in the transit configuration (i.e. operable to travel along the support surface 500 with the chassis 200 (i.e. base of the chassis) spaced apart from the support surface 500.

Hence there is provided a self-propelled gun system which is relatively lightweight and yet stable, with a suspension system configured for transit and gun operation. The reduction in weight is achievable, in part, by the provision of the recoil mitigation system 900 (i.e. the recoil support leg 902 for resisting recoil in the vertical (z) direction, and wheel brake control device 600 configured for applying a braking force to chassis support wheels 404 and, where present, the recoil support leg wheel 922 for resisting recoil in the horizontal (x) direction) and as well as restricting the amount the gun barrel can pivot about the y-axis and/or z-axis.

Hence this solution provides recoil mitigation without adding any extra weight to the platform, and thus allows for effective recoil management on lighter systems.

That the vehicle is operable to accelerate into "free recoil" more or less unimpeded (i.e. with no or low braking forces being applied during acceleration phase) before subsequently being brought to rest by damping systems/brakes, minimises forces on the vehicle, thus extending its operational life.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A self-propelled gun system comprising:

a chassis extending along an x-axis, a first end of the chassis and a second end of the chassis spaced apart from one another along the x-axis, the chassis extending along a y-axis, a first side of the chassis and a second side of the chassis spaced apart from one another along the y-axis, the x-axis being at right angles to the y-axis;

a gun barrel having a gun barrel axis, the gun barrel being mounted to the chassis by a pivot mount, the gun barrel being pivotable relative to the x-axis about a pivot axis aligned and/or parallel with the y-axis;

a chassis suspension system comprising a wheel arm extending away from the chassis to a wheel, the wheel being rotatably mounted on the wheel arm, the wheel configured for engagement with, and travelling along, a support surface to support the chassis, when in transit, a distance (Dz) apart from the support surface in a z-axis, the z-axis being perpendicular to the x-axis and y-axis; and a recoil mitigation system comprising a recoil support leg which extends away from the chassis to a foot end, the foot end operable to engage with the support surface during firing of a projectile from the gun barrel, the foot end operable to be spaced apart from the support surface when the gun system is in transit, the recoil support leg configured to react against recoil force (Fr) in the z-axis from the firing of a projectile from the gun barrel, the recoil mitigation system further comprising a wheel brake control device configured for applying a braking force to the wheel after the firing of a projectile from the gun barrel and after the wheel has started rotating along the support surface in response to the firing of a projectile from the gun barrel.

2. The self-propelled gun system of claim 1, wherein the gun barrel is constrained to pivot about the pivot axis in a plane of movement extending through the x-axis and z-axis and/or is constrained to pivot about the pivot axis between −5 degrees to the x-axis and +75 degrees to the x-axis.

3. The self-propelled gun system of claim 1, wherein the gun barrel is rotatable about the z-axis, limited to be rotatable no more than +/−5 degrees relative to a direction parallel to the x-axis around the z-axis.

4. The self-propelled gun system of claim 1, wherein the recoil support leg is pivotable and/or extendable between:

a first configuration in which the foot end of the recoil support leg is spaced apart from the support surface when the gun system is in transit; and a second configuration in which the foot end is engaged with the support surface during firing of a projectile from the gun barrel.

5. The self-propelled gun system of claim 1, wherein the foot end of the recoil support leg comprises a sledge configured to frictionally engage with the support surface to inhibit movement of the chassis in the x-axis by a recoil force (Fr) from the firing of a projectile from the gun barrel.

6. The self-propelled gun system of claim 1, wherein the wheel is a first wheel, and the foot end of the recoil support leg is defined by a second wheel rotatably mounted to recoil support leg.

7. The self-propelled gun system of claim 6, wherein the wheel brake control device is a first wheel brake control device, the gun system further comprising a second wheel brake control device configured for applying a braking force to the second wheel after the firing of a projectile from the gun barrel and after the first wheel has started rotating along the support surface in response to the firing of a projectile from the gun barrel.

8. The self-propelled gun system of claim 7, wherein one or each of the first and second wheel brake control devices is a regenerative braking device, magnetic impedance braking device, and/or friction braking device.

9. The self-propelled gun system of claim 8, wherein one or each of the first and second regenerative braking devices is operably linked with a rechargeable electric storage device and generates an electrical current by decelerating the first wheel and/or second wheel, respectively, and thereby dissipating recoil of the gun barrel.

10. The self-propelled gun system of claim 9, further comprising a processor in communication with the rechargeable electric storage device and one or each of the first and second regenerative braking devices, such that in response to a movement of the chassis along the support surface, the processor causes the one or each of the first and second regenerative devices to decelerate the first wheel and/or second wheel.

11. The self-propelled gun system of claim 1, wherein the wheel arm extends away from the chassis to the wheel at an angle to the x-axis, y-axis and/or z-axis, and a resilient suspension unit extends between the chassis and the wheel arm.

12. The self-propelled gun system of claim 1, wherein the gun barrel has: a front end; a muzzle provided towards the front end; a rear end; and a breech assembly provided at the rear end.

13. The self-propelled gun system of claim 1, wherein the gun barrel is coupled to a recoil mechanism comprising a recuperator for mitigating a recoil force (Fr) along the gun barrel axis from the firing of a projectile from the gun barrel.

14. The self-propelled gun system of claim 1, wherein the chassis suspension system further comprises a leg strut, the leg strut pivotably attached to the chassis at a coupling end, and extending to a foot configured for engagement with the support surface to support the chassis apart from the support surface.

15. The self-propelled gun system of claim 1, wherein the unladen mass of the self-propelled gun system is no greater than 10 tonnes.

16. The self-propelled gun system of claim 1, wherein the unladen mass of the self-propelled gun system is no greater than 5 tonnes.

17. A gun system comprising:

a chassis;

a gun barrel;

a chassis suspension system comprising a wheel arm extending away from the chassis to a wheel, the wheel being rotatably mounted on the wheel arm, the wheel configured for engagement with, and travelling along, a support surface; and a recoil mitigation system comprising a recoil support leg which extends away from the chassis to a foot end, the foot end operable to engage with the support surface during firing of a projectile from the gun barrel, the foot end operable to be spaced apart from the support surface when the gun system is in transit, wherein when engaged with the support surface, the recoil support leg is configured to react against recoil force from the firing of a projectile from the gun barrel, the recoil mitigation system further comprising a wheel brake control device configured for applying a braking force to the wheel after the firing of a projectile from the gun barrel.

18. The gun system of claim 17, wherein:

the wheel is a first wheel, and the foot end of the recoil support leg is defined by a second wheel rotatably mounted to recoil support leg;

the wheel brake control device is a first wheel brake control device included in a regenerative braking system; and the regenerative braking system further includes a second wheel brake control device configured for applying a braking force to the second wheel after the firing of a projectile from the gun barrel, a rechargeable electric storage device, and a processor in communication with the rechargeable electric storage device and one or each of the first and second wheel brake control devices, such that in response to a movement of the chassis along the support surface, the processor causes the one or each of the first and second wheel brake control devices to decelerate the first wheel and/or second wheel.

19. A gun system comprising:

a chassis;

a gun barrel;

a chassis suspension system comprising a wheel arm extending away from the chassis to a wheel, the wheel being rotatably mounted on the wheel arm, the wheel configured for engagement with, and travelling along, a support surface; and a recoil mitigation system comprising a recoil support leg which extends away from the chassis to a foot end, the foot end operable to engage with the support surface during firing of a projectile from the gun barrel, the foot end operable to be spaced apart from the support surface when the gun system is in transit, wherein when engaged with the support surface, the recoil support leg is configured to react against recoil force from the firing of a projectile from the gun barrel, the recoil mitigation system further comprising a wheel brake control device configured for applying a braking force to the wheel after the wheel has started rotating along the support surface in response to the firing of a projectile from the gun barrel.

20. The gun system of claim 19, wherein the wheel arm extends away from the chassis to the wheel, and a resilient suspension unit extends between the chassis and the wheel arm, and the gun barrel is coupled to a recoil mechanism comprising a recuperator for mitigating a recoil force along a gun barrel axis from the firing of a projectile from the gun barrel.

* * * * *